United States Patent [19]

Bollig et al.

[11] 4,071,074

[45] Jan. 31, 1978

[54] ROLLER APRON FOR A CONTINUOUS CASTING INSTALLATION

[75] Inventors: Georg Bollig, Sao Paulo-Santa Amara, Brazil; Hans Streubel; Manfred Kolakowski, both of Dusseldorf, Germany

[73] Assignee: Schloemann-Siemag Aktiengesellschaft, Dusseldorf, Germany

[21] Appl. No.: 584,183

[22] Filed: June 5, 1975

[30] Foreign Application Priority Data

June 11, 1974 Germany ..... 2428213

[51] Int. Cl.[2] ..... B22D 11/12

[52] U.S. Cl. ..... 164/448

[58] Field of Search ..... 164/282, 82; 266/189, 266/190, 194; 308/77

[56] References Cited

U.S. PATENT DOCUMENTS

| | | | |
|---|---|---|---|
| 3,149,890 | 9/1964 | Selby | 308/77 X |
| 3,447,591 | 6/1969 | Foldessy | 164/282 |
| 3,550,675 | 12/1970 | Hess et al. | 164/282 |
| 3,586,094 | 6/1971 | Machida | 164/282 |
| 3,638,713 | 2/1972 | Knell et al. | 164/82 |
| 3,645,323 | 2/1972 | Vogt et al. | 164/282 |
| 3,710,847 | 1/1973 | Schoffmann | 164/282 |
| 3,722,576 | 3/1973 | Gallucci | 164/282 |
| 3,946,798 | 3/1976 | Uchimoto et al. | 164/282 |

*Primary Examiner*—Robert D. Baldwin
*Attorney, Agent, or Firm*—Werner W. Kleeman

[57] ABSTRACT

A roller apron for a continuous casting installation and serving to support a partially solidified strand cast at a continuous casting installation, especially a steel strand. The roller apron comprises a number of pairs of rollers of different diameter arranged in succession in the direction of travel of the strand. The cast strand is preferably a slab and there are arranged in alternate sequence in the roller apron larger size rollers mounted externally of the maximum slab width and one or more smaller size rollers, wherein each such smaller size roller has at least one of its bearings or supports mounted within the maximum slab width.

14 Claims, 8 Drawing Figures

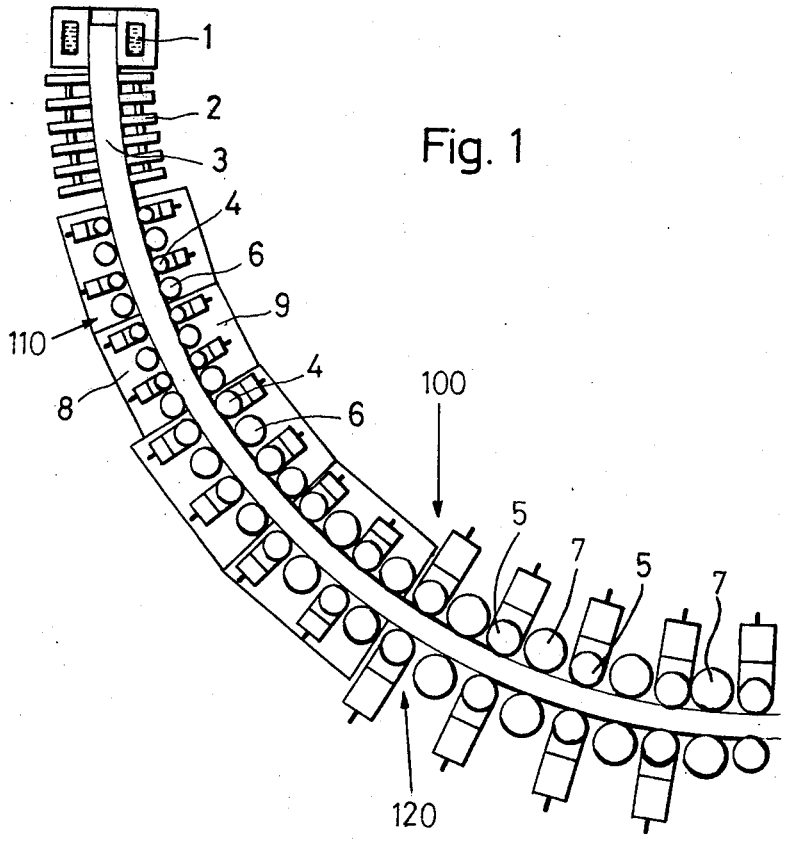
Fig. 1
Fig. 6
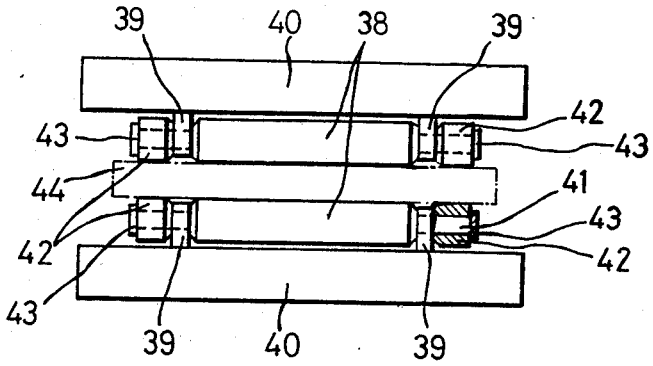

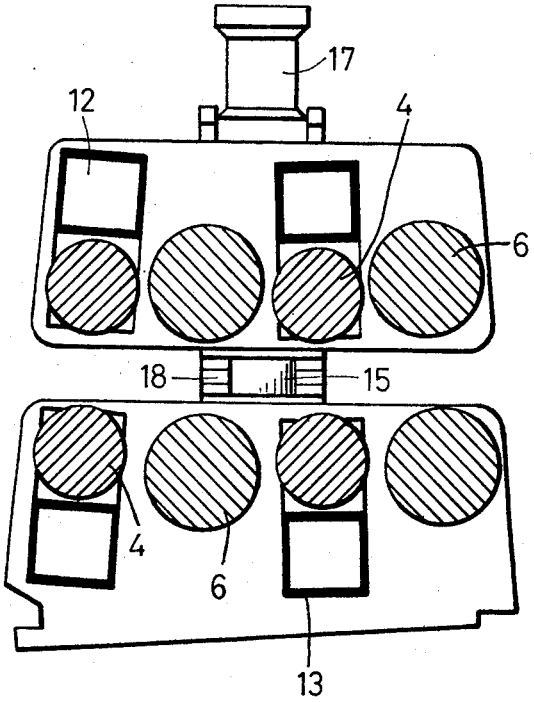
Fig. 2
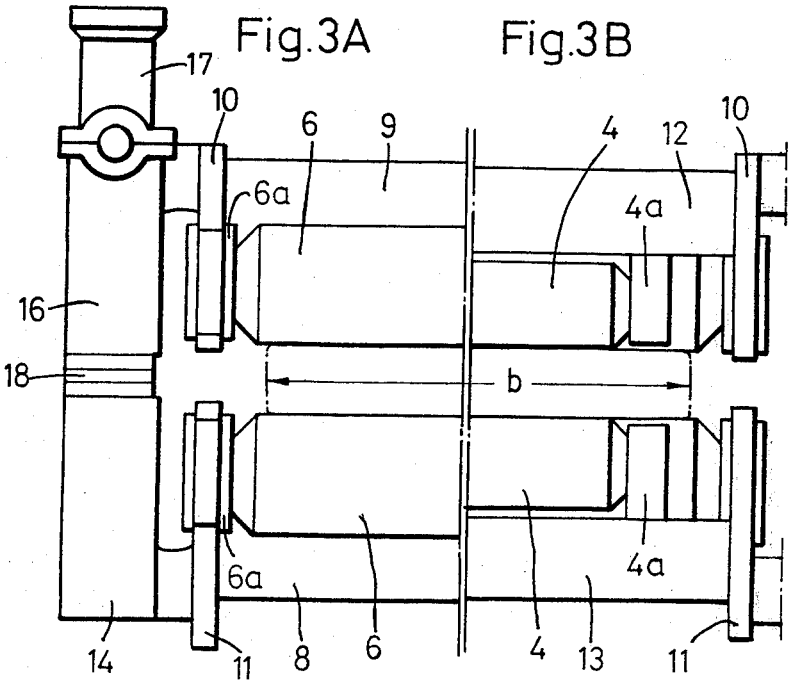

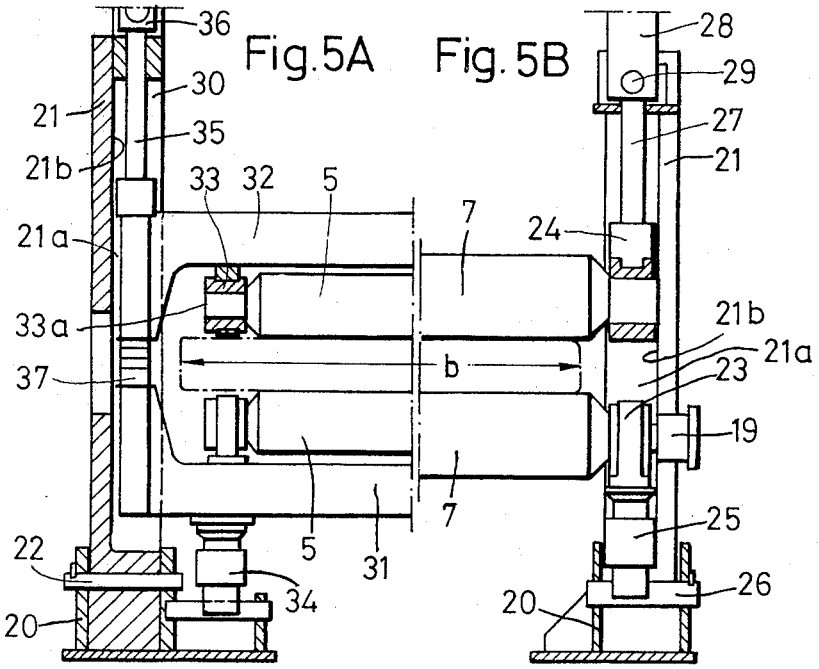
Fig.5A
Fig.5B
36
30
21
35
21b
33
32
5
7
21a
33a
37
b
22
20
34
31
28
29
27
24
21b
21a
23
19
25
26
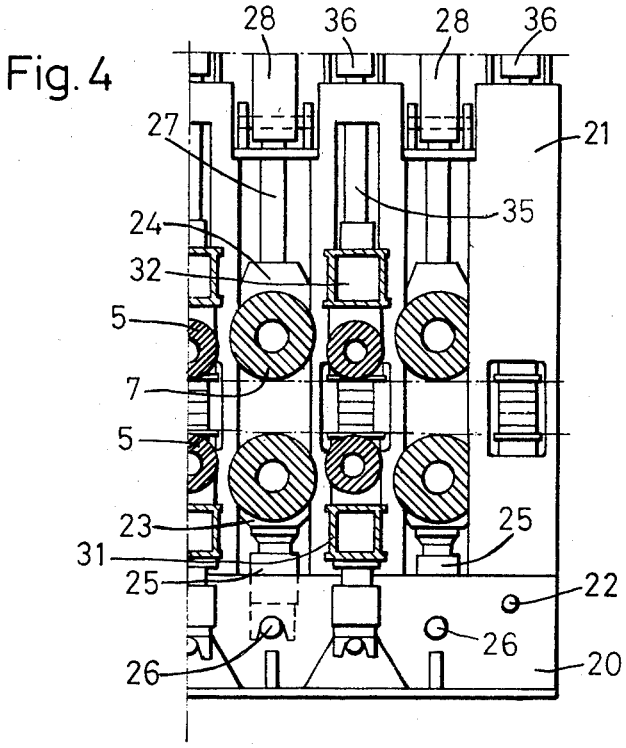
Fig. 4
28
36
27
21
35
24
32
5
7
23
25
31
22
26
20

ROLLER APRON FOR A CONTINUOUS CASTING INSTALLATION

BACKGROUND OF THE INVENTION

The present invention relates to a new and improved construction of strand guide assembly — also known in the art as a roller apron or roller apron assembly — for supporting a partially solidified cast strand in a continuous casting installation, such roller apron comprising a number of pairs of rollers of different diameter successively arranged in the direction of travel of the strand, each of the rollers being supported at two bearing or support locations. As a matter of convenience in the disclosure of the invention to follow the strand guide assembly will be conveniently simply referred to as a roller apron or roller apron assembly.

The guide rollers of continuous casting installations or plants are subjected to a high mechanical alternating load during each revolution of such guide rollers owing to the ferrostatic pressure acting upon the skin or shell of the continuously cast strand. In the case of slab casting installations such high mechanical loads can exceed 100 tons per roller. Apart from the foregoing mechanical load the rollers are subjected to an additional load owing to the shock-like temperature increase of the roller surface each time that it comes into contact with the hot strand. These mechanical and thermal loads, depending upon the strength of the material from which the rollers are fabricated, require a predetermined diameter of the rollers. Since the ferrostatic pressure decreases as a function of the distance from the molten metal level in the continuous casting mold, prior art roller aprons are constructed such that in sections, viewed in the discharge direction of the continuously cast strand, there are provided rollers possessing increasing diameters.

The momentarily employed roller diameter dictates a predetermined minimum spacing between the rollers and thus also the size of the unsupported surface of the strand between the rollers. The mutual dependency between the permissible roller load, the strand width, the thickness of the strand shell or skin, the diameter of the rollers and the spacing of successive rollers limits, in the case of large strand formats or shapes, the casting speed since there must be prevented deleterious bulging-out of the cast strand and metal breakouts. Hence, strands having a width of, for instance, 2.5 to 3 meters cannot be rationally cast with the heretofore known apparatuses.

There are already known to the art roller aprons wherein the strand guiding or guide rollers are constructed of a number of parts and supported over the width of the strand in a number of locations by bearings or supports. In this way, it is possible to maintain relatively small both the diameter and thus also the mutual spacing of successive guide rollers. However, a drawback of such complicated construction resides in the fact that for each multi-part constructed strand guide roller there are required three or more bearings. Significant in this regard is the fact that the bearings are not readily accessible for repair or replacement work, constituting a significant drawback. Additionally, in the case of driven rollers, the individual roller sections must be interconnected by couplings. Hence, these complicated roller aprons or strand guides do not fulfill the requirements concerning a simple, sturdy and operationally reliable construction.

Continuing, there is also already known in this particular field of technology a withdrawal and straightening machine for continuous casting installations wherein the rollers which are particularly loaded by the straightening forces are dimensioned to be larger in size than the normal or standard rollers by virtue of their more intensive loading. In order to insure for a uniform bearing spacing the rollers which immediately neighbor the larger size rollers are constructed to be of smaller size than the standard rollers. With this prior art construction either the aforementioned smaller size rollers are under-dimensioned or the standard rollers which are loaded with the same intensity are over-dimensioned. With this proposal there is not attained any general reduction in the unsupported surfaces of the cast strand and thus an increase of the casting speed.

SUMMARY OF THE INVENTION

Hence, with the foregoing in mind it is a primary object of the present invention to provide an improved construction of roller apron for a continuous casting installation which avoids the drawbacks of the state-of-the-art constructions discussed above.

Another and more specific object of this invention aims at the provision of a relatively simple, sturdy roller apron for wide continuously cast strands, especially wide slabs, wherein the unsupported surfaces of the strand between the rollers are small with their being present acceptable roller loads, so as to be able to cast such wide slabs at high casting speeds while preventing bulging-out of the slab or cast strand.

The present invention is predicated upon the concept that when utilizing the self-supporting effect at the edges of the slab the support spacing at these regions can be enlarged.

Now in order to implement the previously enumerated objects, and others which will become more readily apparent as the description proceeds, the roller apron or strand guide assembly of this development is manifested by the features that there are alternately arranged in the roller apron larger size rollers mounted externally of the maximum slab width and one or more smaller size rollers having at least one bearing thereof mounted within the maximum slab width.

A particularly advantageous constructional manifestation of the invention is realized if there are arranged in alternate sequence a smaller size roller and a larger size roller. The reduction of the bearing spacing of each second roller renders possible the use of thinner, i.e., smaller size rollers without overloading or increasing the bearing locations. By means of a reduction of the roller spacing and thus the unsupported surfaces at the central region of the slab there is realized the possibility of bringing about the strived for increase of the casting speed when casting wide slabs. Yet, also when casting narrow slabs it is possible to increase the casting speed at such continuous casting installations, resulting in optimum utilization of the capacity of the casting plant throughout wide program ranges.

Furthermore, it is to be appreciated that in a roller apron the larger size rollers and smaller size rollers can be mounted in groups at stationary or adjustable yokes respectively, wherein the bearings of the smaller size rollers are arranged at the yoke traverses or crosstie rods or the like. This construction is particularly suitable for the upper portion of the roller apron.

The bearings of the larger size or stronger rollers and the traverses or crosstie rods carrying the bearings of the smaller size or weaker rollers can be however also arranged individually between upright or frame side plates so as to be stationary or displaceable transversely with respect to the strand. This construction appears to be particularly advantageous for the withdrawal and straightening zone or region of the roller apron. Moreover, the larger size rollers mounted externally of the maximum slab width are advantageously provided with drive means.

In order to safeguard against overheating the bearings of the smaller size rollers arranged at the traverses are provided with cooling devices.

According to a further aspect of the invention the length of the working surface of the smaller size rollers is preferably equal to or greater than the maximum slab width reduced by twice the roller gauge, i.e., the spacing between neighboring rollers.

A further reduction of the roller diameter and the roller spacing can be realized if the smaller size rollers are provided with journals extending past the bearings and upon which journals there are arranged in an overhung position support rings.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 schematically illustrates the roller apron or roller apron assembly of an arc-type or curved continuous casting installation;

FIG. 2 illustrates in partially sectional view a roller apron segment for four pairs of support rollers;

FIGS. 3A and 3B respectively illustrate two partial front views of the roller apron segment depicted in FIG. 2 in order to show certain details thereof;

FIG. 4 is a fragmentary sectional view of a portion of the roller apron with individually mounted rollers or rolls;

FIGS. 5A and 5B are two respective fragmentary views, partially in cross-section, illustrating details of the roller apron section or portion portrayed in FIG. 4; and FIG. 6 illustrates roller apron rollers equipped with external guide rings.

DETAILED DESCRIPTION OF THE INVENTION

Referring now to the drawings, it is to be first of all understood that only enough of the structure of the continuous casting installation has been conveniently illustrated in the drawings to enable those skilled in the art to readily understand the underlying concepts of this development. Thus, in FIG. 1 there is schematically illustrated a continuous casting installation for the continuous casting of strands 3, especially slabs, and which continuous casting installation will be seen to embody a continuous casting mold 1 following which there is arranged a conventional strand guide grid arrangement 2 and following such a roller apron or roller apron assembly, generally indicated by reference character 100, and in the description to follow usually referred to as a roller apron. Since in the exemplary illustrated embodiment there is shown a curved continuous casting installation the continuously cast strand 3 is guided from its arcuate or curved configuration as it emanates from the continuous casting mold 1 and the strand guide grid arrangement 2 through the roller apron 100 into a substantially horizontal position. Now in the roller assembly 100 there are alternately arranged in succession smaller or weaker rollers 4, 5 and larger or stronger rollers 6, 7.

In the context of this disclosure — and assuming as is generally the case the rollers are formed of the same material — the expression "smaller or smaller size or weaker" rollers is intended to generally mean rollers of smaller diameter in relation to the diameter of the so-called "larger or larger size or stronger" rollers. In particular, and relating such terminology to any given roller apron section of the roller apron or roller apron assembly 100 there is specifically intended to mean that as concerns such given roller apron section the same contains both larger size and smaller size rollers. Stated in another way, the larger or stronger rollers of any given roller apron section possess a greater resistance to bending than the smaller or weaker rollers thereof. Moreover, as will be apparent from the discussion to follow each of the so-called larger or stronger rollers of the entire roller apron or roller apron assembly need not possess the same diameter and the same is likewise the case for the smaller or weaker rollers. In this regard there should be noted the different diameters of the larger size rollers 6, 7 of the roller apron sections designated by reference characters 110 and 120 in FIG. 1 and equally the different diameters of the smaller size rollers 4, 5 of such respective roller apron sections 110 and 120. Furthermore, a roller of a given roller apron section which for that section would be considered a larger size roller (note for instance the size of the rollers 6 in relation to that of the rollers 4 of roller apron section 110), could be in fact smaller in size in relation to the size of even both the larger and smaller rollers of another, typically downstream located roller apron section viewed in the direction of strand travel (note for instance that for the roller apron section 110 even the larger size rollers 6 thereof are smaller in size than both the larger rollers 7 and smaller rollers 5 of the downstream located roller apron section 120). Furthermore, it is to be specifically understood that in stating that the smaller rollers 4, 5 and the larger rollers 6, 7 are alternately arranged in succession or successively arranged, such arrangement is not intended to be limited in any way whatsoever to a smaller roller followed by a larger roller and so forth, since, as will be explained more fully hereinafter, it would be possible for instance to have a roller arrangement wherein two smaller size rollers are followed by a larger size roller by way of example.

Continuing, and as best seen by referring to FIGS. 2, 3A and 3B at the upper region of the roller apron 100 there are mounted in each instance four outer rollers 4, 6 and four inner rollers 4, 6 in confronting yokes 8, 9 or equivalent structure. Each of these yokes, for instance the yoke 8 and the yoke 9 consists of the lateral bearing or support plates 11 and 10 respectively, wherein it will be seen that the confronting pairs of lateral support plates 11 of the lower yokes 8 are interconnected by the traverses or crosstie rods 13 or the like and similarly the confronting lateral bearing plates 10 of the upper yokes 9 are likewise interconnected by traverses or crosstie rods 12 or the like. In the bearing or support plates 10, 11 there are rotatably mounted the larger size rollers 6, wherein as a matter of convenience in illustration in FIG. 3A there have only been shown the bearings *6a* appearing at the left-hand side of such illustrated rollers 6, and it is to be understood that bearings, like the bearings 6*a* are provided at the opposite nonillustrated end of each of such rollers 6. The smaller or weaker rollers 4 are rotatably mounted at a lesser spacing than the maximum slab width *b* at the traverses 12, 13. In particular, it will be seen by referring to FIG. 3B that these rollers 4 are mounted at their opposed ends in the bearings 4*a* (only the bearings 4*a* at the right-hand side of the rollers of FIG. 3B being shown, but comparable bearings are arranged at the opposite ends of such rollers) and it will be noted that at least one of the pairs of bearings for each such roller 4, such as the depicted bearings 4*a* at the right-hand side of such rollers are supported at the traverses 12, 13 at a location within the maximum slab width *b*. At this point it is to be further mentioned that the previously discussed lateral bearing or support side plates 10, 11 are also sometimes referred to herein as upright or frame side plates.

Continuing, it should be understood that the yokes 8 are anchored to a not particularly illustrated frame or the like. At the outside of the bearing or upright side plates 11 there are arranged holders or supports 14 for columns 15, this structure being shown in FIG. 3A and as a matter of convenience in illustration omitted from the showing of FIG. 3B. The yokes 9 are guided by means of external sleeves 16 at the columns 15. At each guide sleeve 16 there is arranged a hydraulic piston and cylinder arrangement 17, the non-visible piston rod of which is attached internally of the associated column 15. Furthermore, between the holders or supports 14 and the guide sleeves 16 there are provided spacer elements 18 for accommodating the roller spacing to the shape or format of the cast strand 3.

It is to be expressly understood that the invention is in no way intended to be solely limited to the described construction of roller apron segments. Thus, for instance, there is also conceivable by way of example a construction wherein two outer smaller size rollers are grouped together with an intermediate roller. In this case two smaller size or weaker rollers follow one another in succession.

It will be recalled that in conjunction with FIGS. 1, 2, 3A and 3B there was described the roller apron at the upper region thereof, i.e., at the region closer to the continuous casting mold 1 and the strand guide grid arrangement 2. There will now be considered in conjunction with FIGS. 4, 5A and 5B the construction of the roller apron at the lower region thereof and constituting the lower withdrawal and straightening zone. Thus, it will be seen that substantially U-shaped uprights or supports 21 are anchored by bolts 22 or equivalent structure at a frame 20. For instance, as best seen by referring to FIG. 5B between the side plates 21*a* (only one of which is visible in such Figure) and provided with the guide surfaces 21*b* of two uprights 21 there are guided the bearings 23, 24 of the larger size or stronger withdrawal and straightening rollers 7. Further, as best seen by referring to FIGS. 4 and 5B each of the bearings 23 of the lower larger size or stronger rollers 7 is suspended by an hydraulic shock absorber 25 or equivalent structure mounted at the bolts 26 or the like. The bearings 24 of the upper larger size or stronger rollers 7 are operatively connected in each instance with a piston rod 27 of a respective hydraulic piston and cylinder arrangement 28, each such piston and cylinder arrangement being hingedly connected by a respective pivot pin or shaft 29 with the uprights 21. For purposes of driving the larger size rollers 7 there are provided the schematically illustrated driving and coupling means 19, and it should be understood that the manner in which any of the rollers of the roller apron assembly are driven is not crucial and thus any appropriate prior art drive means suitable for this purpose can be employed. Comparable drive means or a drive and coupling arrangement, such as the unit 19, can be employed for driving any selected ones of the rollers of the other roller apron sections of the roller apron or roller apron assembly 100.

As best seen by referring to FIG. 5A between the machined inner wall 30 of the substantially U-shaped uprights or supports 21 there are guided the traverses or crosstie rods 31, 32, at which there are arranged the smaller size or weaker rollers 5 having the bearings 33 which are cooled by the schematically indicated bearing cooling means 33*a*. Again it is to be appreciated that while in the roller arrangement shown in FIGS. 5A and 5B there have only been portrayed one end of such rollers 5 and 7 respectively with the associated bearings 33 and 23, 24 respectively, the opposite ends of such rollers would be equally provided with a similar bearing in order to rotatably support each such roller. Again, as best seen by referring to FIG.5A at least one of the bearings 33 of each roller 5 is again arranged inwardly of the maximum width *b* of the cast strand 3 or slab. The lower traverse or crosstie rods 31 are suspended by hydraulic shock absorbers 34. The upper traverses 32 are operatively connected with the piston rods 35 of hydraulic piston and cylinder arrangements 36 hingedly connected with the uprights 21. The spacing of these traverses 31 and 32 from one another can be limited by the spacer elements 37 which are accommodated to the shape or format of the casting or cast strand.

In FIG. 6 there is illustrated an arrangement of strand guide rollers 38, the bearings 39 of which are mounted at the traverses or crosstie rods 40. These strand guide rollers 38 are equipped at their opposed ends with bearing journals 41 or the like which protrude past the bearings 39, as shown. Upon such protruding bearing journals 41 there are arranged in an overhang fashion guide rings 42 which are held by the disks 43 or the like. The guide rings 42 which are loaded by the forces exerted by the cast strand 44 thus exert a restoring moment upon the central or intermediate portion of the strand guide rollers and reduce the bending-through thereof.

While there are shown and described present preferred embodiments of the invention, it is to be distinctly understood that the invention is not limited thereto, but may be otherwise variously embodied and practiced within the scope of the following claims.

We claim:

1. A roller apron assembly for supporting a partially solidified strand at a continuous casting installation, especially for casting steel strands, comprising a plurality of pairs of cooperating rollers having roller ends and following one another in spaced relationship in the direction of travel of the cast strand, at least one roller pair possessing rollers having a different diameter of its rollers than the diameter of the rollers of another roller pair of said plurality of pairs of cooperating rollers, said pairs of rollers of respectively different diameter following one another in sequence, each of said rollers being rotatably mounted by only two bearings, said at least one roller pair defining larger size rollers each having a strand supporting portion, the bearings of said larger size rollers being mounted externally of the strand supporting portion, said another roller pair defining smaller size rollers, at least one smaller size roller having at least one of its bearings mounted within the strand supporting portion of the larger size rollers, said at least one smaller size roller having a strand supporting portion extending only between its two bearings such that said strand is adapted to be unsupported outwardly of the said at least one of the bearings of said one smaller size roller, whereby said one smaller size roller is adapted to rely upon the self-supporting effect of the strand edge for supporting the cast strand at that location.

2. The roller apron assembly as defined in claim 1, further including yoke means at which there are mounted in groups at least some larger size rollers and at least some smaller size rollers, said yoke means having traverses, the bearings of the smaller size rollers being arranged at the yoke traverses.

3. The roller apron assembly as defined in claim 2, wherein at least some of said yoke means are stationarily arranged.

4. The roller apron assembly as defined in claim 2, further including means for displaceably adjusting at least some of said yoke means.

5. The roller apron assembly as defined in claim 1, further including substantially upright spaced side plates between which there are individually mounted the bearings of the larger size rollers and the bearings of the smaller size rollers.

6. The roller apron assembly as defined in claim 5, further including means for stationarily mounting at least some of the bearings of said rollers.

7. The roller apron assembly as defined in claim 5, further including means for displaceably mounting at least some of the bearings of said rollers.

8. The roller apron assembly as defined in claim 5, further including means for displaceably mounting the bearings of the larger size rollers and the bearings of the smaller size rollers.

9. The roller apron assembly as defined in claim 1, further including drive means for driving at least the larger size rollers having the bearings thereof mounted externally of the maximum slab width.

10. The roller apron assembly as defined in claim 1, wherein the bearings of the smaller size rollers are provided with bearing cooling means.

11. The roller apron assembly as defined in claim 1, wherein said plurality of spaced pairs of rollers have the spacing between each two successive roller pairs defining a roller gauge, and wherein the smaller size rollers have a working surface length which is approximately equal to the maximum width of the cast slab less twice the roller gauge.

12. The roller apron assembly as defined in claim 1, wherein said plurality of spaced pairs of rollers have the spacing between each two successive roller pairs defining a roller gauge, and wherein the smaller size rollers have a working surface length. which is greater than the maximum width of the cast slab reduced by twice the roller gauge.

13. The roller apron assembly as defined in claim 1, wherein both bearings of said at least one smaller size roller are mounted within the strand supporting portion of the larger size rollers.

14. The roller apron assembly as defined in claim 1, wherein each smaller size roller has the bearings thereof mounted within the strand supporting portion of the larger size rollers.

* * * * *